US005378326A

United States Patent [19]

Kumpulainen

[11] Patent Number: 5,378,326

[45] Date of Patent: Jan. 3, 1995

[54] FEEDING METHOD AND DEVICE FOR ALUMINUM ELECTROLYSIS

[75] Inventor: Vesa Kumpulainen, Espoo, Finland

[73] Assignee: Kumera Oy, Riihimaki, Finland

[21] Appl. No.: 75,024

[22] Filed: Jun. 11, 1993

[51] Int. Cl.[6] ..... C25C 3/06; C25C 3/14

[52] U.S. Cl. ..... 204/67; 204/245

[58] Field of Search ..... 204/67, 245, 243 R

[56] References Cited

U.S. PATENT DOCUMENTS

| | | | |
|---|---|---|---|
| 2,713,024 | 5/1951 | Mantovanello | 204/67 |
| 5,045,168 | 9/1991 | Dalen et al. | 204/245 |

FOREIGN PATENT DOCUMENTS

| | | | |
|---|---|---|---|
| 0066481 | 9/1975 | Australia | 204/243 R |
| 1171626 | 6/1964 | Germany | 204/243 R |
| 1064372 | 4/1967 | United Kingdom | 204/245 |
| 2058137 | 4/1981 | United Kingdom . | |
| 126271 | 4/1960 | U.S.S.R. . | |
| 1191491 | 11/1985 | U.S.S.R. . | |

*Primary Examiner*—Kathryn Gorgos
*Attorney, Agent, or Firm*—Steinberg, Raskin & Davidson

[57] ABSTRACT

A method and device for feeding a raw material, such as aluminum oxide, into an aluminum electrolysis using a reciprocatingly vibrating feeding means in which a raw material is carried into a controlling box positioned in proximity to the surface of electrolyte melt. Mechanical vibrations are directed at a feeding device positioned inside the controlling box. The vertical amplitude of the vibrations is selected in the range of about 0.5 cm to about 1.5 cm. The oscillation frequency of the vibrations is selected in the range of about 11 Hz to about 40 Hz. Raw material is continuously fed by the feeding device into the electrolysis through an opening produced in the crust of the electrolyte melt around the controlling box.

20 Claims, 2 Drawing Sheets

FEEDING METHOD AND DEVICE FOR ALUMINUM ELECTROLYSIS

BACKGROUND OF THE INVENTION

The present invention relates to a method and device for feeding powderized raw material, such as aluminum oxide, into an electrolyte melt in which aluminum electrolysis occurs, and in which a reciprocatingly vibrating feeding means is used.

The invention is classified within the electrolytic production range of aluminum, and it can be used for feeding aluminum oxide and other equivalent materials into all kinds of electrolysis processes.

In prior art methods and devices, the aluminum electrolysis process is accomplished as a continuous process with a raw material being fed into the electrolysis process usually intermittently at given time intervals. Typically, the feeding takes place by penetrating the crust of an electrolysis and by carrying an uncontrolled portion of aluminum oxide into an electrolyte melt, which prior to penetration had been spread upon the crust.

In connection with such prior art methods, major failures and drawbacks occur which cause instability in the electrolysis process. This is primarily due to the fact that the aluminum oxide concentration in the electrolyte melt, in which electrolysis occurs, changes from the maximum value of the charging moment to a minimum value of the starting phase of an anode effect. As a result, the consumption of electrical energy increases and the efficiency of the process decreases, causing precipitation on the bottom of the electrolyte melt. This precipitation has the significant drawback of causing disturbances in the activity of the electrolysis.

Another current significant problem in electrolytic aluminum production by means of the prior art devices is to guarantee a reliable and simple continuous feeding of the raw material in the electrolysis without increasing the breaking of the crust of the electrolyte so that a sufficiently uniform aluminum oxide concentration can be maintained in the electrolysis.

In the prior art, U.S. Pat. No. 2,713,024 describes a method for continuously feeding aluminum electrolysis wherein aluminum oxide is fed continuously under the molten surface with the aid of a feeding means in a pipe positioned on the surface of electrolyte melt. The aluminum oxide is carried in the form of an aluminum oxide column formed in the inlet point into the electrolyte melt with pressure provided with the feeding means. A particular feature of the method described in this patent is that the feeding means which produce the feeding pressure of the aluminum oxide column is not in contact with the electrolyte melt. The feeding process described in this U.S. patent can be used, irrespective of the anode melt, in an electrolysis of any power. In addition, the process is carried out with a screw, piston, or an equivalent type feeding means.

In spite of certain advantages of the above-mentioned U.S. patent, it has not achieved wide-spread use because at the point in which raw material is taken through the electrolyte crust into the electrolyte melt, large forces are created as a result of the rapid growth of the inlet point.

An aluminum oxide feeding method for aluminum electrolysis is also known in the prior art from U.S.S.R. Inventor's Certificate No. SU 126 271. This reference describes the feeding of aluminum oxide into an electrolytic process using a vibration method in order to accelerate the dissolution of aluminum oxide in the electrolyte melt and to prevent precipitation on the bottom of the electrolyte melt. The method described by this U.S.S.R. Inventor's Certificate is implemented by using a spherical tank provided with holes, which is immersed in the electrolyte melt and vibrated horizontally. The aluminum oxide in the spherical tank is under the influence of vibration and dissolves in the electrolyte melt. According to another alternative embodiment of this reference, the implementation of the method is carried out with a horizontal, vibrating plate, in which the amplitude of vibration is directed horizontally. This prior art method is not applied in practice because maintaining the surface of the molten electrolyte open in the aluminum oxide feeding point is difficult because a crust is produced rapidly on the surface of the electrolyte when cold aluminum oxide enters into contact with the electrolyte melt.

In addition, with regard to the prior art, reference is made to the following patents: U.S.S.R. Inventor's Certificate No. SU 1,191,491, U.S. Pat. No. 5,045,168, and Great Britain Patent Application No. 2,058,137.

OBJECTS AND SUMMARY OF THE INVENTION

It is an object of the present invention to develop further the above described prior art methods and devices so that the above mentioned drawbacks can be substantially avoided.

It is another object of the present invention to provide a new and improved method and device in which vibrating feeding means are utilized to feed an electrolyte melt. The feeding means are arranged to vibrate at a selected frequency and amplitude such that the feeding material is continuously fed through an opening in the electrolyte melt.

For achieving the above mentioned objects and others, in the present invention, the raw material is carried to a controlling box placed adjacent to a molten surface of an electrolyte melt and mechanical vibration forces are directed at the feeding means positioned within the controlling box. The vertical amplitude of the vibration forces is selected in a range of from about 0.5 cm to about 1.5 cm and the vibration frequency is selected in a range of about 11 Hz to about 40 Hz. The raw material is continuously fed through an opening in the electrolyte crust of the electrolyte melt produced around the controlling box which controls the feeding means. In this regard, the raw material may be in a powderized form so that it can pass through the opening in the crust.

At the opening in the electrolyte crust and in general proximity thereto, the electrolyte crust is continuously being formed. The thickness of the crust is also considerable, particularly in the proximity of the inlet area. This is due to the fact that at the original aluminum oxide feeding moment into the electrolyte, the crust is produced in the electrolyte and the thickness thereof increases to a certain extent during the continued feeding of cold aluminum oxide. Thereafter, aluminum oxide starts to accumulate on the crust and forms a layer thereon. When the aluminum oxide column touches the feeding means, its active effect on the column starts, such that a penetration force is transmitted to the crust of the electrolyte.

The crust depresses down in the operation zone of the feeding means when subjected to the penetration forces and forms an opening through which aluminum oxide will be fed into the electrolyte melt. The strength and thickness of the crust around the opening is, as stated above, considerable, and therefore, when the aluminum oxide column is depressed through the opening, large friction forces are produced which must be overcome with the aid of the feeding means. In accordance with the present invention, the use of vibration of vertical vibratory amplitude reduces the friction forces in supplying aluminum oxide into the electrolyte.

In order to make the conveyance of the raw material into the electrolyte, and removal of anode gases from below the crust, more reliable, it is advantageous to insert the vibrating feeding means from time to time into the molten electrolyte. This step cleans the opening in the electrolyte crust and prevents it from closing.

In the method in accordance with the present invention, when compared with the other methods of feeding an electrolysis as known in the prior art, the following advantages are achieved:

- energy costs are decreased by reducing friction forces at the inlet point when the aluminum oxide is fed into the electrolysis reaction,
- the operational reliability of the actuating means increases,
- service time of the actuating means is extended,
- apparatus implementations are simplified,
- consumption of electrical energy in the electrolysis process is reduced,
- current efficiency increases by about 1–3%,
- electrolytical thermal balance increases because raw material is carried into the melt without breaking the crust of the electrolyte,
- the quality of the metal improves because entry of impurities into the electrolysis can be prevented,
- personnel working costs diminish considerably, and raw material losses are reduced.

BRIEF DESCRIPTION OF THE DRAWINGS

The following drawings are illustrative of an embodiment of the invention and are not meant to limit the scope of the invention as encompassed by the claims.

DETAILED DESCRIPTION OF THE INVENTION

Figure 1:
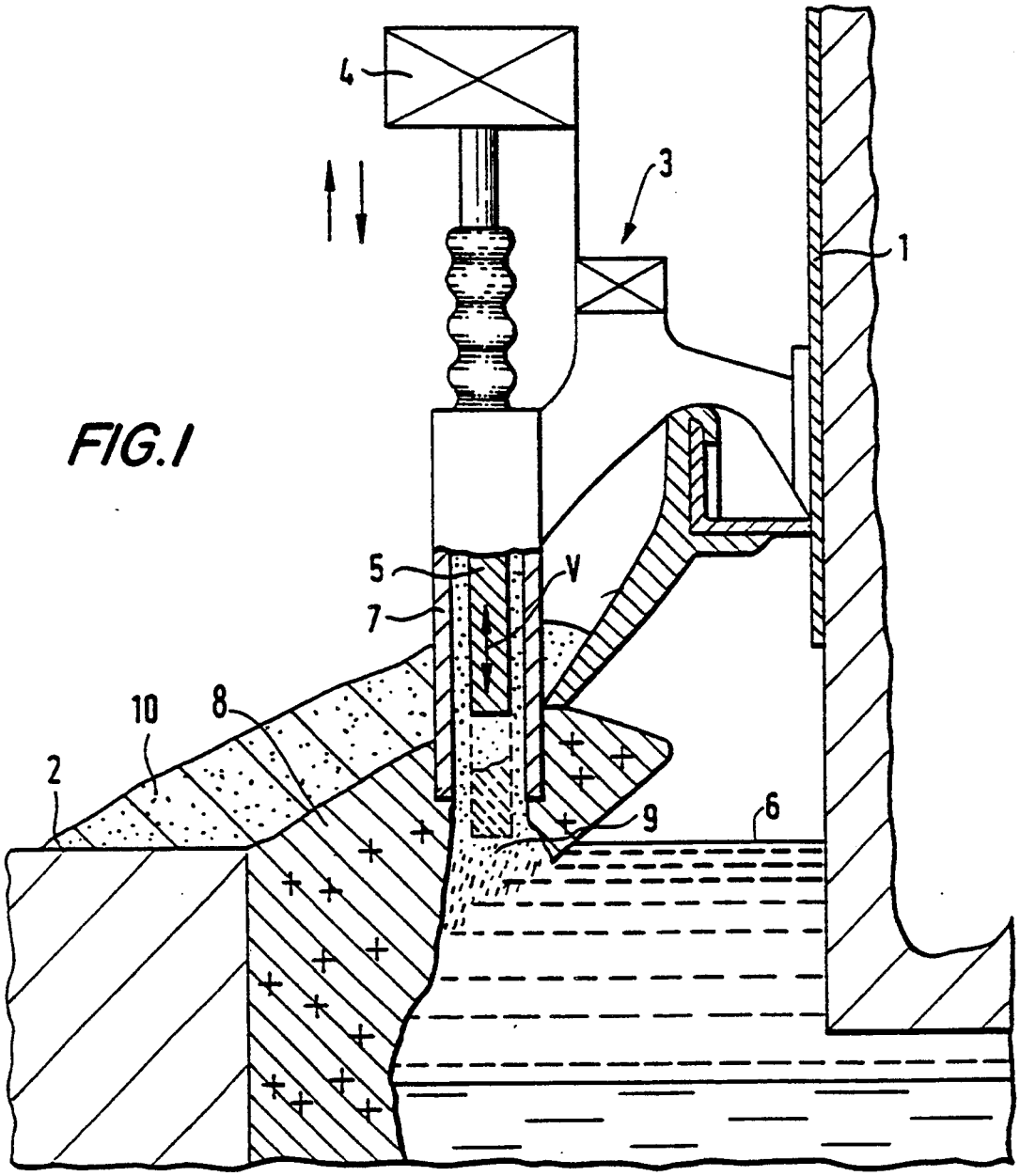
FIG. 1 shows a schematic illustration of a partial vertical section of an electrolysis reactor intended for producing aluminum in accordance with the device and method of the invention.

Referring to FIG. 1, an electrolysis device for producing alumina comprises an anode apparatus 1, a cathode apparatus 2, and an apparatus by which raw material is fed through a feed pipe 3, or other feeding apparatus, into an electrolyte melt in which electrolysis occurs. The feeding apparatus comprises a vibrator 4, also referred to as vibration actuating means, and feeding means 5 which is installed in a controlling box 7 located above the surface of the electrolyte melt 6. The electrolyte melt has a hard crust 8 in which an opening 9 has been produced at a point where raw material is fed into the electrolysis reaction.

The feeding of the raw material for the electrolysis reaction is carried out as follows. Raw material enters the controlling box 7 below the feeding means 5. When the feeding means 5 vibrates, the raw material travels slowly downwards while becoming warm at the same time. Heating means, either internal or external (not shown) may be applied to heat the raw material during its passage in the controlling box 7. When progressing downward through the controlling box 7, raw material enters the electrolysis cell below the feeding means 5 and accumulates in that location. When the column of raw material, preferably aluminum oxide, touches the feeding means 5, the active influence thereof starts on the column and transmits a penetration force into the crust 8 of the electrolyte melt. In other words, the aluminum oxide itself acts as a penetrating tool for the continuously producing electrolyte crust at the inlet point of the raw material. As a result of the penetration force, the crust 8 becomes penetrated in the operational range of the feeding means 5 and the opening 9, through which the aluminum oxide is continuously fed in, is kept open.

In order to make the raw material feeding into the electrolyte melt as reliable as possible, the feeding means 5 is immersed from time to time into the molten electrolyte melt so that the opening 9 will stay in working condition. In a preferred process, aluminum oxide is used as the raw material. However, the device and method of the present invention can be used for other electrolysis reactions.

The above-described method in accordance with the invention was tested in industrial circumstances. With the reciprocating vibration V being applied to the feeding means 5, the frictional forces of the aluminum oxide column were substantially reduced relative to the walls of the opening 9 of the electrolyte melt. At the same time, the energy consumption required to convey the raw material into the melt was substantially reduced. In addition, the reliability of the feeding process and the efficiency of feeding raw material into the electrolysis reaction increased.

The amplitudes and frequencies of the vibration V of the feeding means 5 are determined on, e.g., the basis of the tests carried out in the industrial conditions. The vibration amplitudes were selected with the purpose of making the aluminum oxide to move reliably under the feeding means 5. When the amplitude of the vibrations V was below about 0.5 cm, it was found that the aluminum oxide blocked the controlling box 7, resulting in considerable loads in the vibration actuating means 4, so that the aluminum oxide was not being fed into the melt 6. If the amplitude of the vibrations was over about 1.5 cm, the structure of the vibration actuating means 4 became much more complex. In the range of amplitudes between about 0.5 cm and about 1.5 cm, a nonintermittent, continuous feeding could be provided.

With regard to the frequency of the vibrations of the feeding means 5, at a frequency in the range of about 11 Hz to about 40 Hz, the friction forces, produced when the aluminum oxide column penetrated the crust 8 of the electrolyte melt and formed opening 9, were minimal. However, at a frequency of over about 40 Hz, there was increased consumption of the energy transfer agent, e.g., compressed air, although no significant reduction in friction forces could be discerned. When the frequency is below about 11 Hz, the frequency of the vibrations of the feeding means 5 approaches the specific oscillations of human beings, which in turn will cause grave consequences to human health such that a person working in proximity to the feeding means becomes tired very easily. The frequency of the human specific oscillations is in the range of about 7 Hz to about 10 Hz.

The vibration of the feeding means 5 is asymmetric such that the movement of the feeding means 5 in a downward direction is more rapid than its movement in an upward direction. With a mode of operation as such, condensed micro-portions of raw material are continuously fed into the melt 6 without any crust formation in the raw material feeding point.

The use of the feeding means 5 with disharmonious amplitude frequency parameters has been selected because as a result, the presence and formation of such resonance phenomena which would have a negative effect on the operation of the electrolysis can be substantially prevented. This would occur when the frequencies of the disturbing forces of the feeding means 5 and the electrolysis are harmonious.

EXAMPLE

In the following, an embodiment example of the method in accordance with the present invention as used in an industrial electrolysis reaction at 175 ka current will be described.

In accordance with the invention, a feeding means 5 is connected to a pneumatic drive means or vibrator 4, and positioned in a controlling box 7 at an anode means 1 on the surface of an electrolyte melt. For the operation of the drive means 4, compressed air which is fed at a maximum of about 5 bar pressure was used. The oscillation frequency and amplitude of the pneumatic drive means 4 can be controlled by regulating the feeding of compressed air to the pneumatic drive means. In a conventional manner, aluminum oxide was fed continuously under the feeding means 5 through a pipe 3 on the basis of a calculation according to which the combined 24 hr consumption is about 2000 kg per electrolysis reaction. When the feeding is carried out in two spots, the consumption of each spot should be about 1000 kg per 24 hrs, i.e., about 0.7 kg per minute. When the mode of feeding includes four spots, the consumption should be about 500 kg per 24 hrs, i.e., about 0.35 kg per minute. Aluminum oxide was fed to one spot at the rate of about 0.35 to about 1.0 kg per minute consumption.

A preferred range of the amplitude of the vibration V of the feeding means 5 was found to be from about 0.8 cm to about 1 cm and the preferred range of the frequency was found to be from about 15 Hz to about to 25 Hz. When the feeding means was started and began feeding the aluminum oxide, an electrolyte crust 8 was formed in the aluminum feed area and in the adjacent areas thereof. Thereafter, an aluminum oxide layer 10 covered the crust 8 of the electrolyte melt and the layer 10 became gradually increased in size until the uppermost layer of aluminum oxide reached the feeding means 5.

In the operating range of the feeding means 5, the aluminum oxide became condensated and the vibration forces were transmitted through the condensated aluminum oxide column to the crust 8 of the electrolyte melt, which was broken, i.e., such that an opening 9 was formed through which aluminum oxide was continuously fed into the melt 6. When an opening 9 was penetrated into the crust 8 of the electrolyte melt, the forces of the vibrator 4 were considerable, but after the penetration, the operation of the vibrator 4 was almost idling although aluminum oxide was still being continuously fed into the melt 8, and the feeding was automatic. When the feeding load was increased, the power used by the vibrator 4 gradually increased, and vice versa, e.g., when the feeding load was decreased, the power consumption of the vibrator 4 was reduced. Such a mode of operation is of great importance in these particular circumstances.

In the feeding process, the vibrating feeding means 5 are moved vertically downwards by about 100 to about 150 mm to the molten electrolyte operating zone at about 30 to about 60 minute intervals in order to help maintain the opening 9 in the electrolyte crust 8 open.

Adjustment of the amplitude and/or frequency settings of the drive means 4, and also together therewith the adjustment of the feeding means 5, was carried out by increasing or decreasing the quantity of the air to be fed into the pneumatic drive means 4.

Other features of the present invention include the fact that raw material can be conveyed into the melt 6 using the method of the invention at any point and location in the electrolysis basin. The method is applicable for any electrolysis type using one or more baked anode or self-baking anodes. The method is not confined to electrolysis of a given power, and the number of aggregates in feeding raw material may be varied as needed.

Figure 2:
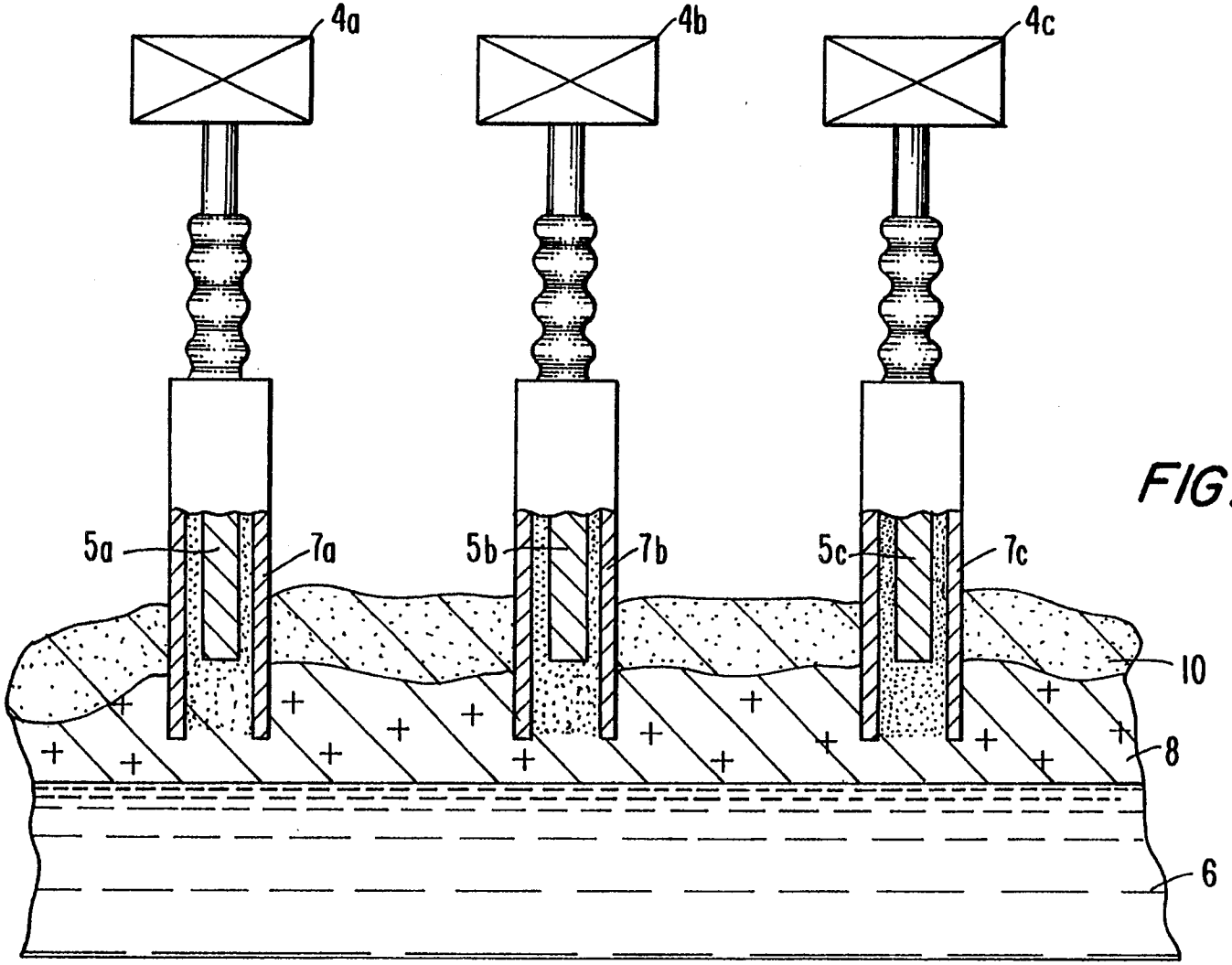
FIG. 2 shows a side view of an embodiment of an electrolysis in accordance with the device and method of the invention wherein a plurality of feeding means are arranged to feed the electrolysis.

Referring to FIG. 2, if in association with one electrolysis reaction, several feeding apparatuses operating according to the method of the present invention are used, it is preferable to select the vibration frequencies of various feeding means to be mutually of different magnitude in order to avoid the harmful resonances of the vibrations induced from the feeding means into the various structures of the electrolysis.

In FIG. 2, an embodiment of the present invention is illustrated wherein the electrolysis is fed from several feeding means. In this embodiment, controlling boxes *5a,5b,5c* are connected to corresponding feeding means *7a,7b,7c* and vibrators, e.g., pneumatic drive means, *4a,4b,4c*, respectively. The controlling boxes are positioned in proximity to the surface of the electrolyte melt 6. The feeding means *5a,5b,5c* may be operated simultaneously in the method and the vibration frequencies thereof are selected to be mutually different. This prevents resonance oscillations of the supporting structures of the electrolysis reaction. In a similar manner to the embodiment shown in FIG. 1, when the feeding means *5a,5b,5c* start to operate and begin feeding the aluminum oxide into the electrolyte melt, an electrolyte crust 8 is formed in the aluminum feed area and in the adjacent areas thereof. An aluminum oxide layer 10 covers the crust 8 of the electrolyte and the layer 10 becomes gradually increased in size with the additional feeding of the aluminum oxide until the uppermost layer of aluminum oxide reaches the feeding means *5a,5b,5c*.

In accordance with the invention, the aluminum oxide becomes condensated and vibration forces are transmitted through the condensated aluminum oxide column to the crust 8 of the electrolyte melt, which is broken, i.e., such that an opening is formed therein. Through this opening, aluminum oxide is continuously fed into the melt 6.

The examples provided above are not meant to be exclusive. Many other variations of the present invention would be obvious to those skilled in the art, and are contemplated to be within the scope of the appended claims.

I claim:

1. A method for feeding raw material into an aluminum electrolysis reaction, comprising the steps of:

arranging a controlling box in proximity to a crust of an electrolyte melt in which electrolysis occurs, feeding a raw material through feeding means arranged within said controlling box into a space defined between said feeding means and the crust of the electrolyte melt, and directing mechanical vibration forces at said feeding means, such that upon sufficient accumulation of raw material in said space supported on the crust of the electrolyte melt, said feeding means are vibrated into contact with the accumulated raw material in said space to urge the raw material to penetrate the crust of the electrolyte melt and form an opening therein through which the raw material passes into the electrolyte melt, said vibration forces having a vertical amplitude in a range of about 0.5 cm to about 1.5 cm and a vibration frequency in a range of about 11 Hz to about 40 Hz.

2. The method of claim 1, wherein the vertical amplitude of said vibration forces is in a range of about 0.8 cm to about 1.0 cm or the frequency of said vibration forces is in a range of about 15 Hz to about 20 Hz.

3. The method of claim 1, further comprising arranging a plurality of controlling boxes having feeding means arranged therein to simultaneously feed the raw material into the electrolyte melt.

4. The method of claim 3, further comprising selecting different vibration frequencies for each of said feeding means in said plurality of controlling boxes to prevent resonance oscillations of supporting structures of the electrolyte melt.

5. The method of claim 1, further comprising moving said feeding means at specific time intervals relative to the electrolyte melt to keep open said opening through which the raw material passes.

6. The method of claim 5, wherein said feeding means are moved in time intervals in a range of about 30 minutes to about 60 minutes.

7. The method of claim 1, further comprising providing said vibration forces by means of a pneumatic drive means.

8. The method of claim 7, further comprising controlling the oscillation frequency and amplitude by regulating feeding of compressed air to the pneumatic drive means.

9. The method of claim 1, wherein the vertical amplitude of said vibration forces is in a range of about 0.8 cm to about 1.0 cm and the frequency of said vibration forces is in a range of about 15 Hz to about 20 Hz.

10. The method of claim 1, further comprising selecting the frequency and amplitude of the vibration forces such that the raw material is continuously fed through the opening in the crust of the electrolyte melt.

11. A device for feeding raw material into an electrolysis reaction, comprising an electrolyte melt in which electrolysis occurs, a controlling box arranged in proximity to a crust of the electrolyte melt, feeding means arranged within said controlling box to feed a raw material into a space between said feeding means and the crust of the electrolyte melt, and vibration means for directing mechanical vibration forces at said feeding means, such that upon sufficient accumulation of raw material in said space supported on the crust of said electrolyte melt, said feeding means are vibrated by said vibration means to contact the accumulated raw material in said space and urge the raw material to penetrate the crust of the electrolyte melt to thereby form an opening therein through which the raw material passes into the electrolyte melt, said vibration forces having a vertical amplitude in a range of about 0.5 cm to about 1.5 cm and a vibration frequency in a range of about 11 Hz to about 40 Hz.

12. The device of claim 11, wherein the frequency of said vibration forces is in a range of about 15 Hz to about 20 Hz.

13. The device of claim 11, wherein the vertical amplitude of said vibration forces is in a range of about 0.8 cm to about 1.0 cm.

14. The device of claim 11, wherein the vertical amplitude of said vibration forces is in a range of about 0.8 cm to about 1.0 cm and the frequency of said vibration forces is in a range of about 15 Hz to about 20 Hz.

15. The device of claim 11, wherein said vibration means comprise pneumatic drive means.

16. The device of claim 11, wherein said feeding means and said controlling box define a space therebetween, the raw material flowing through said space by the effect of said vibration forces on said feeding means.

17. The device of claim 11, wherein the raw material is aluminum oxide.

18. The device of claim 11, further comprising a plurality of feeding means connected to corresponding controlling boxes, said vibration means vibrating each of said feeding means at a different vibration frequency to prevent resonance oscillations of supporting structures of the electrolyte melt.

19. The device of claim 11, wherein said vibration means vibrate said feeding means asymmetrically such that movement of said feeding means in a downward direction toward the crust of the electrolyte melt is more rapid than movement of said feeding means in a direction away from the crust of the electrolyte melt.

20. The device of claim 11, wherein the frequency and amplitude of the vibration forces are selected such that the raw material is continuously fed through the opening in the crust of the electrolyte melt.

* * * * *